US012065810B2

(12) United States Patent
Scheckelhoff

(10) Patent No.: US 12,065,810 B2
(45) Date of Patent: Aug. 20, 2024

(54) SYSTEMS AND METHODS FOR AUTOMATICALLY PERFORMING A FLUSH OPERATION FOR A WATER SUPPLY

(71) Applicant: Haier US Appliance Solutions, Inc., Wilmington, DE (US)

(72) Inventor: Ryan James Scheckelhoff, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 344 days.

(21) Appl. No.: 17/518,740

(22) Filed: Nov. 4, 2021

(65) Prior Publication Data

US 2023/0135904 A1 May 4, 2023

(51) Int. Cl.

| | |
|---|---|
| ***E03B 7/08*** | (2006.01) |
| ***A47L 15/00*** | (2006.01) |
| ***E03B 7/07*** | (2006.01) |
| ***E03B 7/12*** | (2006.01) |

(52) U.S. Cl.

CPC ..... *E03B 7/08* (2013.01); *A47L 15/0018* (2013.01); *E03B 7/071* (2013.01); *E03B 7/12* (2013.01)

(58) Field of Classification Search

CPC ... E03B 7/071; E03B 7/08; E03B 7/12; A47L 15/0018; D06F 39/088

See application file for complete search history.

(56) References Cited

U.S. PATENT DOCUMENTS

| | | | | |
|---|---|---|---|---|
| 6,823,878 | B1 * | 11/2004 | Gadini | C02F 1/485 68/13 A |
| 8,971,694 | B2 | 3/2015 | Deivasigamani | |
| 10,329,745 | B2 | 6/2019 | Serralta | |
| 10,983,536 | B2 | 4/2021 | Ravid | |
| 11,530,531 | B2 * | 12/2022 | Poojary | E03B 7/072 |
| 2010/0132803 | A1 | 6/2010 | Fima | |
| 2011/0162824 | A1 * | 7/2011 | Farrell | F28D 1/047 165/132 |

FOREIGN PATENT DOCUMENTS

| | | | | |
|---|---|---|---|---|
| CA | 2920548 | A1 | 2/2017 | |
| CN | 105122584 | A * | 12/2015 | G05B 15/02 |
| CN | 103866527 | B | 3/2017 | |
| DE | 102018001931 | A1 * | 8/2019 | D06F 39/08 |
| DE | 102019114742 | A1 * | 12/2019 | |
| EP | 3321428 | A1 * | 5/2018 | |
| FR | 3117571 | A3 * | 6/2022 | |
| JP | 10272085 | A * | 10/1998 | |
| JP | 3661345 | B2 * | 6/2005 | |
| RU | 2770757 | C1 * | 4/2022 | D06F 37/266 |

* cited by examiner

*Primary Examiner* — Crystal J Barnes-Bullock
(74) *Attorney, Agent, or Firm* — Dority & Manning, P.A.

(57) ABSTRACT

A method of operating an appliance includes receiving an initiation trigger to perform a flush operation, supplying water to a container of the appliance, draining the supplied water from the container, measuring a temperature of the supplied water to the container, determining that the temperature of the supplied water is above a predetermined temperature threshold, and halting the supply of water to the container via the water supply.

16 Claims, 4 Drawing Sheets

SYSTEMS AND METHODS FOR AUTOMATICALLY PERFORMING A FLUSH OPERATION FOR A WATER SUPPLY

FIELD OF THE INVENTION

The present subject matter relates generally to appliance, and more particularly to methods for flushing water supply pipes for domestic appliances.

BACKGROUND OF THE INVENTION

Many commercial and residential buildings are equipped with domestic appliances. Many of these appliances are connected to municipal water supplies, such as washing machine appliances and dishwashing appliances. The water is selectively supplied to these appliances for use in certain operations, such as washing operations, rinsing operations, and the like. Conventionally, the pipes through which the municipal water is supplied are in a constantly occupied state; in other words, these pipes are filled with stagnant water to be ready to be supplied on demand.

Further, many of the commercial and residential buildings are located in climates which can experience very cold temperatures at certain times of the year. These cold temperatures bring the potential for the pipes to freeze, thus resulting in pipe damage creating water damage within the commercial or residential building. Moreover, some of the commercial or residential buildings may be vacant for extended periods of time, sometimes during the cold months. Extended stagnation of water within the pipes may result in growth of legionella, which in turn may be dispensed into the appliances upon reactivation. If the contaminated water is transferred to humans, serious sicknesses can result.

Accordingly, a method of operating a domestic appliance that obviates one or more of the above-described drawbacks would be beneficial. In particular, a method of operating a domestic appliance that performs routine flushing of water supply and drain pipes would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating an appliance is provided. The appliance may include a water supply, a temperature sensor provided in the appliance, a container, and a drain pump. The method may include receiving a flushing initiation trigger to perform a flushing operation; initiating the flushing operation, the flushing operation including supplying flushing water to the container via the water supply and draining the flushing water from the container via the drain pump; measuring, via the temperature sensor, a temperature of the flushing water supplied to the container; determining that the temperature of the flushing water is above a predetermined temperature threshold; and stopping the flushing operation upon determining that the temperature of the flushing water is above the predetermined temperature threshold.

In another exemplary aspect of the present disclosure, an appliance is provided. The appliance may include a container configured to store a liquid therein; a liquid supply line fluidly connected to the container through which the liquid is supplied to the container; a liquid supply valve provided on the liquid supply line and configured to selectively allow the liquid to pass through the liquid supply line into the container; a temperature sensor provided at one of the liquid supply line or the container, the temperature sensor configured to detect a temperature of the liquid; a drain line fluidly connected with the container through which the liquid drains from the container; a drain pump connected to the drain line to selectively release the liquid from the container; and a controller provided within the appliance, the controller configured to perform a series of operations. The series of operations may include receiving a flushing initiation trigger to perform a flushing operation; initiating the flushing operation, the flushing operation including supplying flushing water to the container via the liquid supply line and draining the flushing water from the container via the drain pump; measuring, via the temperature sensor, a temperature of the flushing water supplied to the container; determining that the temperature of the flushing water is above a predetermined temperature threshold; and stopping the flushing operation upon determining that the temperature of the flushing water is above the predetermined temperature threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
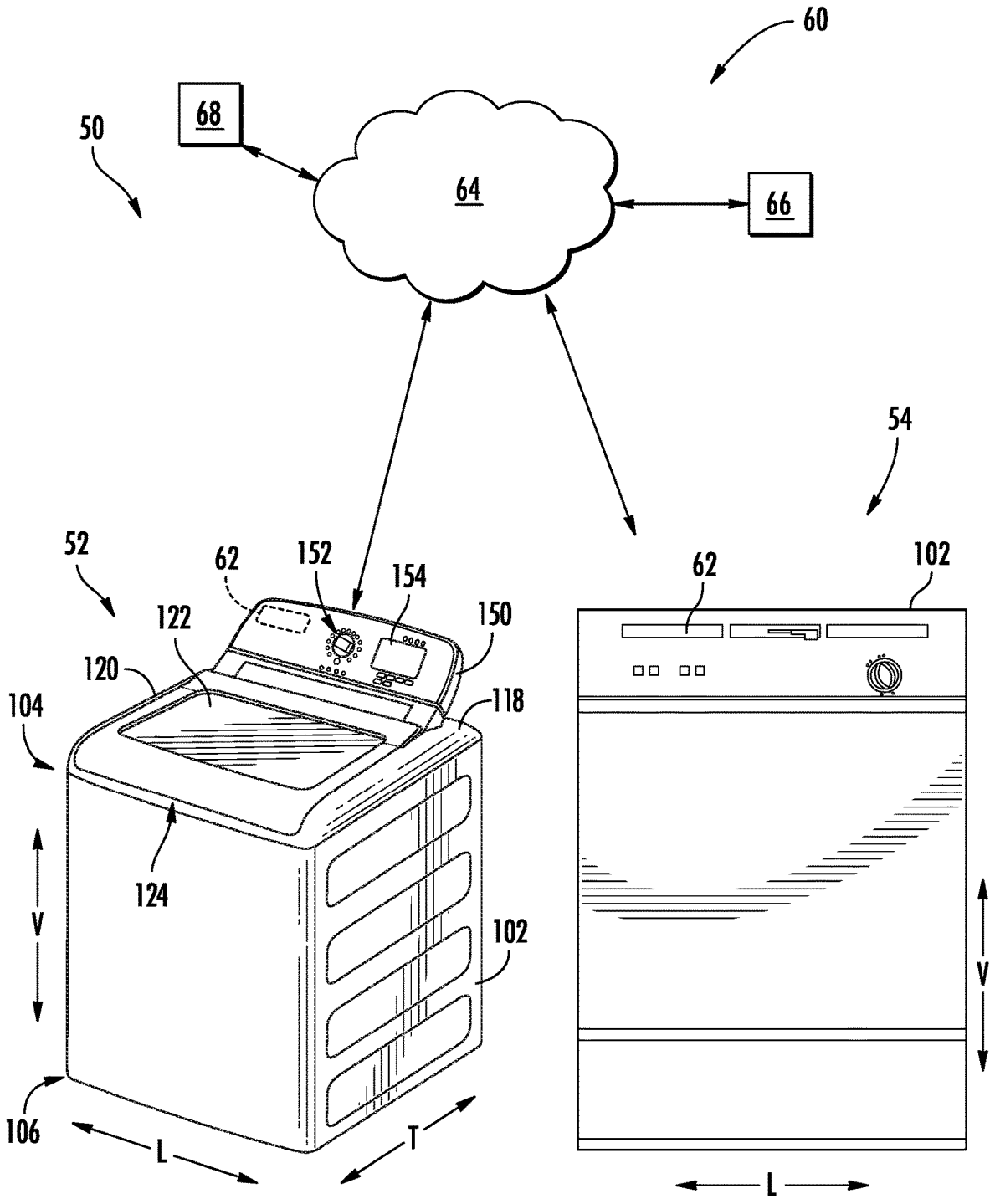
FIG. 1 provides a schematic representation of an appliance system that includes a washing machine appliance, a dishwasher appliance, and an external communication system according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a system of connected appliances 50 according to exemplary embodiments of the present subject matter. As shown, system 50 may include a washing machine appliance 52 and a dishwasher appliance or dishwasher 54, for washing clothes and dishes, respectively. Each of washing machine appliance 52 and dishwasher appliance 54 will be described below according to exemplary embodiments of the present subject matter. Specifically, these figures illustrate various views of washing machine 52 and dishwasher 54 in order to facilitate discussion regarding the use and operation of system 50. However, it should be appreciated that the specific appliance configurations illustrated and described are only exemplary, and the scope of the present subject matter is not limited to the configurations set forth herein. Furthermore, it should be appreciated that like reference numerals may be used to refer to the same or similar features between washing machine 52 and dishwasher 54 (e.g., such as controller 62). Further still, it should be appreciated that certain embodiments of the present disclosure may be performed in one or more additional appliances, e.g., such as a recirculation pump, a water or liquid dispenser, a refrigerator appliance, a water heater, etc.

Referring still to FIG. 1, a schematic diagram of an external communication system 60 will be described according to an exemplary embodiment of the present subject matter. In general, external communication system 60 is configured for permitting interaction, data transfer, and other communications between and among washing machine 52, dishwasher 54, and/or a user of such appliances. For example, this communication may be used to provide and receive operating parameters, cycle settings, performance characteristics, user preferences, or any other suitable information for improved performance of washing machine 52 and/or dishwasher 54.

As illustrated, each of washing machine appliance 52 and dishwasher appliance 54 may include a controller 62 (described in more detail below). External communication system 60 permits controllers 62 of washing machine 52 and dishwasher 54 to communicate with external devices either directly or through a network 64. For example, a consumer may use a consumer device 66 to communicate directly with washing machine 52 and/or dishwasher 54. Alternatively, these appliances may include user interfaces for receiving such input (described below). For example, consumer devices 66 may be in direct or indirect communication with washing machine 52 and dishwasher 54, e.g., directly through a local area network (LAN), Wi-Fi, Bluetooth, Zigbee, etc. or indirectly through network 64. In general, consumer device 66 may be any suitable device for providing and/or receiving communications or commands from a user. In this regard, consumer device 66 may include, for example, a personal phone, a tablet, a laptop computer, or another mobile device.

In addition, a remote server 68 may be in communication with washing machine 52, dishwasher 54, and/or consumer device 66 through network 64. In this regard, for example, remote server 68 may be a cloud-based server 68, and is thus located at a distant location, such as in a separate state, country, etc. In general, communication between the remote server 68 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 64 can be any type of communication network. For example, network 64 can include one or more of a wireless network, a wired network, a personal area network, a local area network, a wide area network, the internet, a cellular network, etc. According to an exemplary embodiment, consumer device 66 may communicate with a remote server 68 over network 64, such as the internet, to provide user inputs, transfer operating parameters or performance characteristics, etc. In addition, consumer device 66 and remote server 68 may communicate with washing machine 52 and dishwasher 54 to communicate similar information.

External communication system 60 is described herein according to an exemplary embodiment of the present subject matter. However, it should be appreciated that the exemplary functions and configurations of external communication system 60 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

Figure 2:
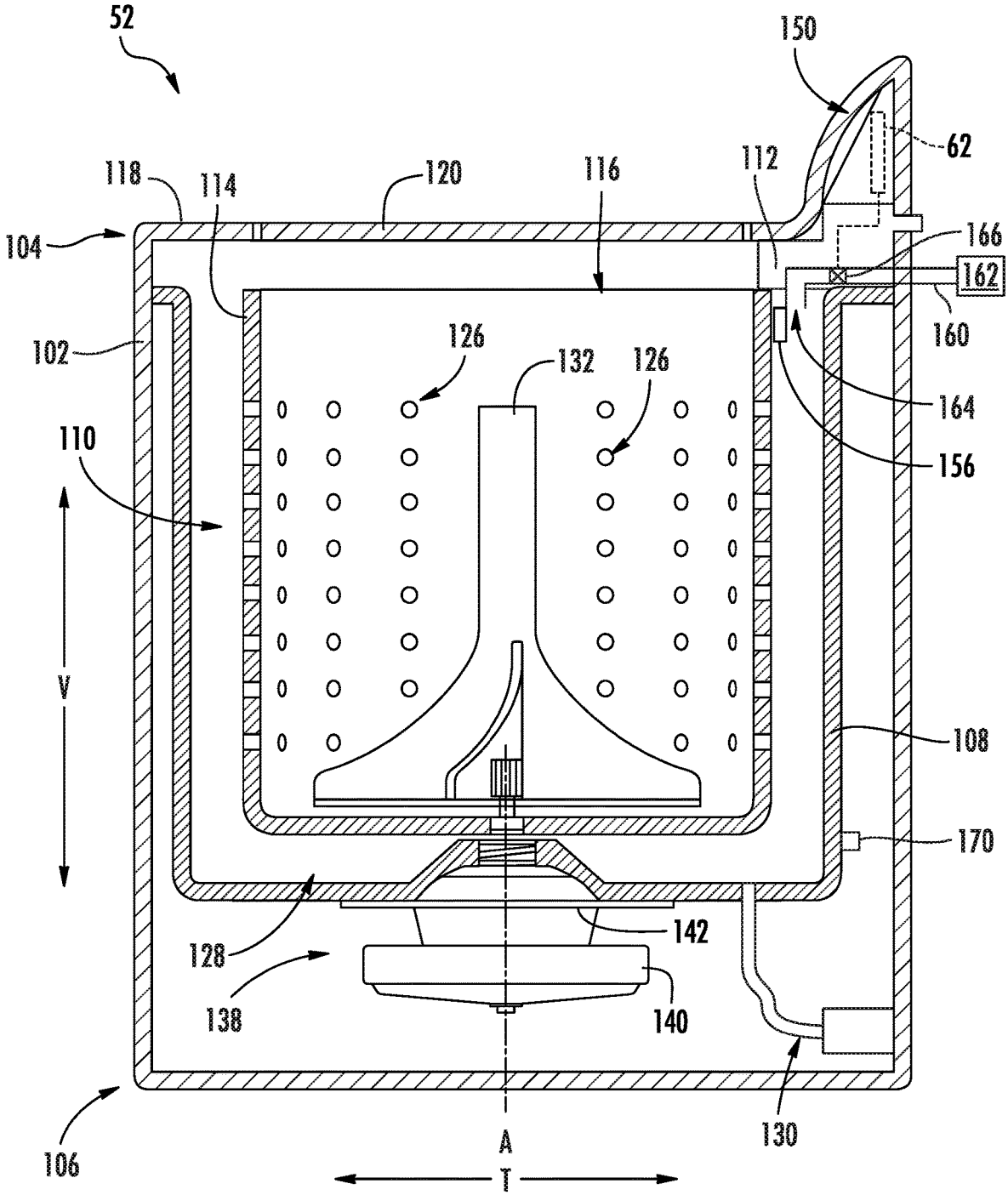
FIG. 2 provides a side cross-sectional view of the exemplary washing machine appliance of FIG. 1.

Referring now to FIG. 2, washing machine appliance 52 will be described according to an exemplary embodiment of the present subject matter. Specifically, an exemplary embodiment of a vertical axis washing machine appliance 52 is described herein. Specifically, FIG. 2 provides a side cross-sectional view of washing machine appliance 52. Washing machine appliance 52 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 52, it should be appreciated that vertical axis washing machine appliance 52 is provided by way of example only. It will be understood that aspects of the present subject matter may be used in any other suitable washing machine appliance, such as a horizontal axis washing machine appliance. Indeed, modifications and variations may be made to washing machine appliance 52, including different configurations, different appearances, and/or different features while remaining within the scope of the present subject matter.

Washing machine appliance 52 has a cabinet 102 that extends between a top portion 104 and a bottom portion 106 along the vertical direction V, between a first side (left) and a second side (right) along the lateral direction L, and between a front and a rear along the transverse direction T. A wash tub 108 may be positioned within cabinet 102, defining a wash chamber 110, and is generally configured for retaining wash fluids or water (e.g., during an operating cycle). Washing machine appliance 52 further includes a primary dispenser 112 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 52 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 52 is generally referred to as a "vertical axis" or "top load" washing machine appliance 52. However, it should be appreciated that aspects of the present subject matter may be used within the context of a horizontal axis or front load washing machine appliance as well. As used herein, terms of approximation, such as "approximately," "substantially," or "about," refer to being within a ten percent margin of error.

As illustrated, cabinet 102 of washing machine appliance 52 has a top panel 118. Top panel 118 defines an opening that coincides with opening 116 of wash basket 114 to permit a user access to wash basket 114. Washing machine appliance 52 further includes a door 120 which is rotatably mounted to top panel 118 to permit selective access to opening 116. In particular, door 120 selectively rotates between the closed position (as shown in FIGS. 1 and 2) and an open position. In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 52. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIG. 2, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 52 further includes a pump assembly 130 that is located beneath wash tub 108 and wash basket 114 for gravity assisted flow when draining wash tub 108.

An impeller or agitation element 132, such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 52, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 2, agitation element 132 and wash basket 114 are oriented to rotate about axis of rotation A (which is substantially parallel to vertical direction V).

Washing machine appliance 52 may include a drive assembly 138 in mechanical communication with wash basket 114 to selectively rotate wash basket 114 (e.g., during an agitation or a rinse cycle of washing machine appliance 52). In addition, drive assembly 138 may also be in mechanical communication with agitation element 132. In this manner, drive assembly 138 may be configured for selectively rotating or oscillating wash basket 114 and/or agitation element 132 during various operating cycles of washing machine appliance 52.

More specifically, drive assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 and 2, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 52 is controlled by a controller or processing device 62 that is operatively coupled to control panel 150 for user manipulation to select washing machine cycles and features. In response to user manipulation of control panel 150, controller 62 operates the various components of washing machine appliance 52 to execute selected machine cycles and features. According to an exemplary embodiment, controller 62 may include a memory and microprocessor, such as a general or special purpose microprocessor operable to execute programming instructions or micro-control code associated with methods described herein. Alternatively, controller 62 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 52 may be in communication with controller 62 via one or more signal lines or shared communication busses.

During operation of washing machine appliance 52, laundry items are loaded into wash basket 114 through opening 116, and washing operation is initiated through operator manipulation of input selectors 152. Wash basket 114 may be filled with water and detergent and/or other fluid additives via primary dispenser 112. One or more valves can be controlled by washing machine appliance 52 to provide for filling wash tub 108 and wash basket 114 to the appropriate level for the amount (or number) of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 2, a water fill process will be described according to an exemplary embodiment. As illustrated, washing machine appliance 52 includes a water supply conduit 160 that provides fluid communication between a water supply source 162 (such as a municipal water supply) and a discharge nozzle 164 for directing a flow of water into wash chamber 110. In addition, washing machine appliance 52 includes a water fill valve or water control valve 166 which is operably coupled to water supply conduit 160 and communicatively coupled to controller 62. In this manner, controller 62 may regulate the operation of water control valve 166 to regulate the amount of water within wash tub 108. In addition, washing machine appliance 52 may include one or more pressure sensors 170 for detecting the amount of water and or clothes within wash tub 108. For example, pressure sensor 170 may be operably coupled to a side of tub 108 for detecting the weight of wash tub 108, which controller 62 may use to determine a volume of water in wash chamber 110 and a subwasher load weight.

Moreover, washing machine 52 may include a temperature sensor 156 configured to detect a temperature of water supplied to tub 108. For instance, temperature sensor 156 may be provided within tub 108. In some embodiments, temperature sensor 156 is provided within water supply conduit 160 (e.g., to detect an immediate temperature of the water supplied to tub 108). It should be noted that temperature sensor 156 may be provided at one, both, or additional locations within washing machine 52. As used herein, "temperature sensor" or the equivalent is intended to refer to any suitable type of temperature measuring system or device positioned at any suitable location for measuring the desired temperature. Thus, for example, temperature sensor 156 may each be any suitable type of temperature sensor, such as a thermistor, a thermocouple, a resistance temperature detector, a semiconductor-based integrated circuit temperature sensors, etc. In addition, temperature sensor 156 may be positioned at any suitable location and may output a signal, such as a voltage, to a controller that is proportional to and/or indicative of the temperature being measured. Although exemplary positioning of temperature sensors is described herein, it should be appreciated that appliance 100 may include any other suitable number, type, and position of temperature, humidity, and/or other sensors according to alternative embodiments.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. After articles disposed in wash basket 114 are cleaned and/or washed, the user can remove the articles from wash basket 114, e.g., by reaching into wash basket 114 through opening 116.

Figure 3:
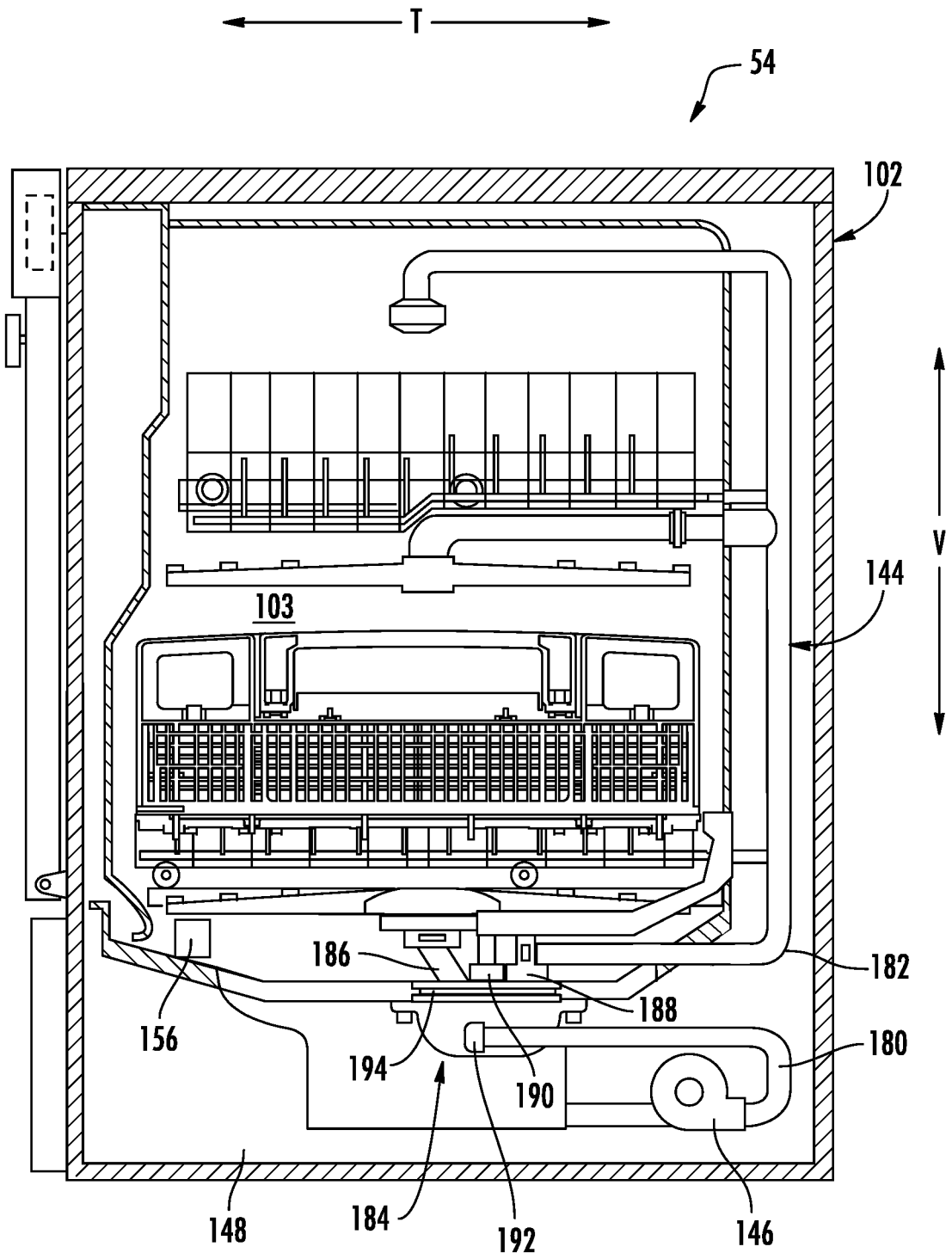
FIG. 3 provides a sectional elevation view of the exemplary dishwasher appliance of FIG. 1.

Referring now to FIG. 3, a general description of dishwasher 54 will be described. Dishwasher 52 may include a cabinet 102 having a tub 103 therein defining a wash chamber. The tub 103 may generally include a front opening and a door hinged at its bottom for movement between a normally closed vertical position (shown in FIGS. 1 and 2), wherein the wash chamber is sealed shut for washing operation, and a horizontal open position for loading and unloading of articles from the dishwasher. Optionally, a latch may be used to lock and unlock the door for access to the chamber.

Generally, the tub 103 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 103 may generally have a rectangular cross-section defined by various wall panels or walls. For example, as shown in FIG. 3, the tub 103 may include a top wall and a bottom wall spaced apart from one another along a vertical direction V of the dishwashing appliance 100. Additionally, the tub 103 may include a plurality of sidewalls (e.g., three sidewalls) extending between the top and bottom walls. It should be appreciated that the tub 103 may generally be formed from any suitable material. For instance, in several embodiments, the tub 103 is formed from a ferritic material, such as stainless steel, or a polymeric material.

A fluid circulation assembly 144 for circulating fluid (e.g., water and dishwasher fluid) may be provided, e.g., within the tub 103. As shown in FIG. 2, the fluid circulation assembly 144 may also include a pump 146 located in a machinery compartment 148 located below the bottom wall of the tub 103. Moreover, as shown in FIG. 2, the fluid recirculation assembly 140 may also include a diverter assembly 184 in fluid communication with the pump 146 for diverting fluid between one or more spray-arm assemblies. For example, the diverter assembly 184 may, in several embodiments, include an inlet 192 coupled to the pump 146 (e.g., via pump conduit 180 shown in FIG. 2) for directing fluid into the diverter assembly 184 and first and second outlets 186, 188 for directing the fluid received from the pump 146 to the lower spray-arm assembly or the mid-level and upper spray-arm assemblies, respectively. In some such embodiments, the first outlet 186 may be configured to be directly coupled to the lower spray-arm assembly and the second outlet 188 may be coupled to a suitable fluid conduit 182 of the fluid recirculation assembly 140 for directing fluid to the mid-level and upper spray-arm assemblies. Optionally, a third outlet 190 may be direct the fluid received from the pump 146 to a variable jet assembly. Additionally, the diverter assembly 184 may also include a diverting valve 194 to selectively divert the flow of fluid through the assembly 184 to the first outlet 186, the second outlet 188, or the third outlet 190.

Similar to the washing machine 52 described above, dishwasher 54 may include one or more temperature sensors 156. Temperature sensor 156 may be provided at one or more locations include within a water supply line or attached to/provided within tub 103. It should be appreciated that the present subject matter is not limited to any particular style, model, or configuration of dishwashing appliance. The exemplary embodiments depicted in FIGS. 1 and 3 are simply provided for illustrative purposes only. For example, different locations may be provided for the user interface 150, different configurations may be provided for the racks and other differences may be applied as well. Moreover still, as mentioned above, the present disclosure may apply to additional appliances.

Now that the general descriptions of exemplary appliances have been described in detail, a method 300 of operating an appliance (e.g., washing machine 52, dishwasher 54) will be described in detail. Although the discussion below refers to the exemplary method 300 of operating one or more of washing machine 52 and dishwasher 54, one skilled in the art will appreciate that the exemplary method 300 is applicable to any suitable domestic appliance having a water supply. In exemplary embodiments, the various method steps as disclosed herein may be performed by controllers 62, remote server 68, and/or a separate, dedicated controller.

In detail, method 300 is directed toward a method for performing a flushing operation via one or more domestic appliances. For instance, each of the domestic appliances may be connected to a water supply source, such as a municipal water supply, via one or more pipes (e.g., plumbed within a building or domicile). Certain instances may arise for which the water provided within the pipes needs to be pumped, flushed, urged, cycled, or otherwise moved to prevent certain occurrences. For at least one example, the pipes may need to be flushed to avoid the water provided therein from freezing and damaging the pipes and/or the appliances. For another example, the pipes may need to be flushed periodically to discourage bacterial growth due to stagnation within the pipes.

Figure 4:
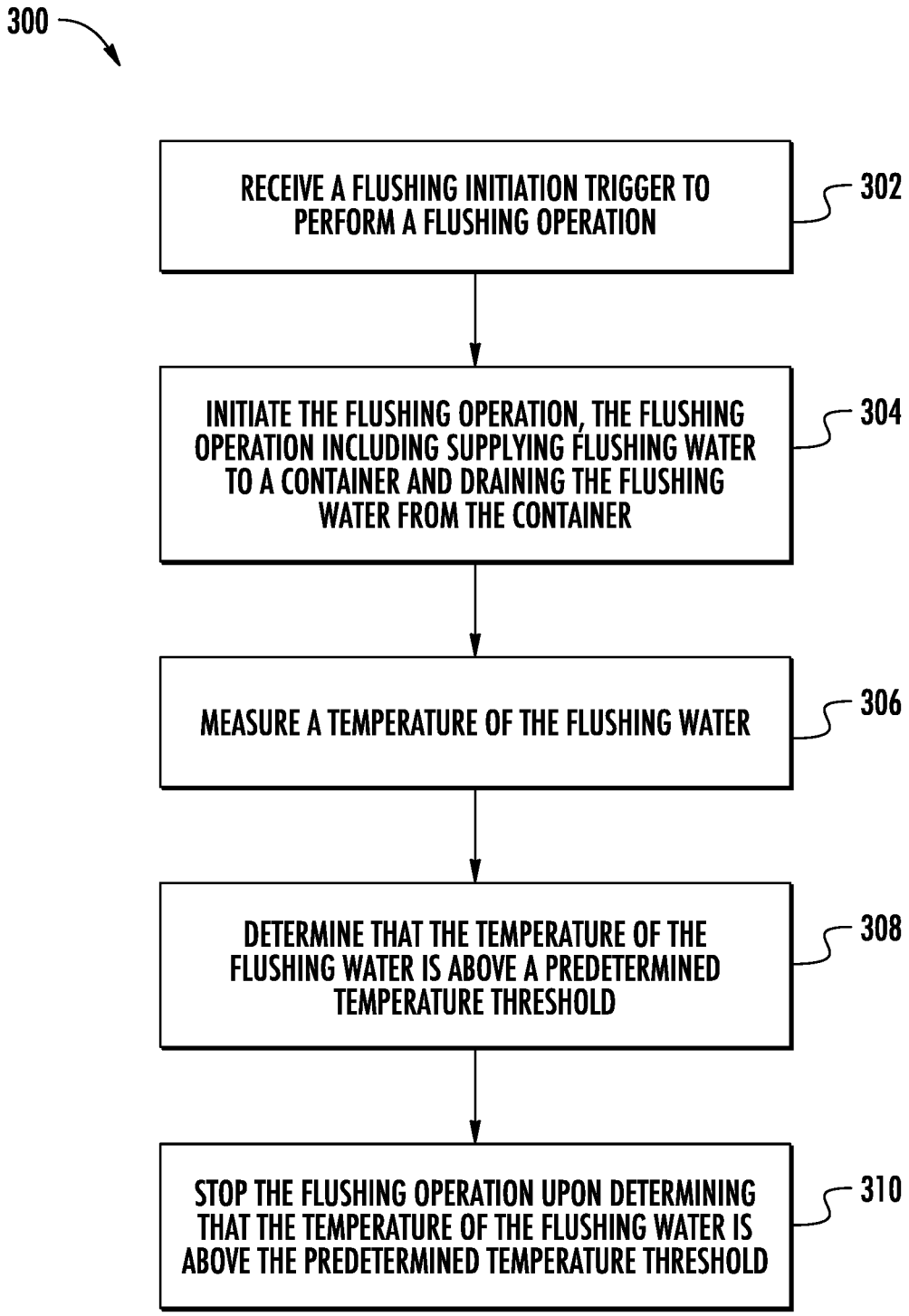
FIG. 4 provides a flow chart illustrating a method of operating an appliance according to exemplary embodiments of the present disclosure.

With reference now to FIG. 4, at step 302, method 300 may include receiving a flushing initiation trigger to perform a flushing operation. In detail, the controller may determine that one or more conditions are present that require the flushing operation to be performed. The flushing initiation trigger may be based at least in part on one or more of an ambient atmospheric temperature, a user input, a time of day, a time of year, a predetermined schedule, or the like. For instance, the appliance may obtain (e.g., via a connected network) a local weather forecast including real time temperatures and/or predicted or forecasted temperatures. Thus, the controller may determine that temperature is or will be below an atmospheric temperature threshold. The atmospheric temperature threshold may be defined as a temperature at which water supply pipes may be in danger of freezing. In some embodiments, the controller considers an extended forecast to determine that the atmospheric temperature is scheduled to be below the atmospheric temperature threshold for an extended period of time, increasing the likelihood of freezing.

According to another embodiment, the flushing initiation trigger is dictated by a user input. In detail, the user may manually start the flushing operation, e.g., via an input through a user interface of the appliance or through a mobile application remotely connected to the appliance. Additionally or alternatively, the user input may be a passive user input. For instance, the user may store a predefined or predetermined schedule for performing the flushing operation. The predetermined schedule may incorporate a vacancy or vacation mode. The vacancy mode may include time periods for which the building will not be occupied by any user, and thus the appliances will not be used (i.e., water will not be circulated through the appliances and thus the supplying pipes).

According to still another embodiment, the initiation trigger may include a calendar trigger. For instance, the appliance may be programmed (e.g., via the user or during manufacture) to perform the flushing operation at a predetermined time of day or time of year. The time of day may be a time of day at which the appliance is unlikely to be used (e.g., overnight). The time of year may be a winter time, or any time period where atmospheric temperatures are typically at or below the atmospheric temperature threshold. Moreover, a combination of two or more of the above-mentioned flushing initiation triggers may be used to initiate the flushing operation, as would be understood.

At step 304, method 300 may include initiating the flushing operation (e.g., in response to receiving the flushing initiation trigger). The flushing operation may include supplying flushing water (e.g., from a water supply) to the appliance and draining the flushing water from the appliance. In detail, the appliance may include a container configured to store a supply of water. In the examples described above, the wash tub (e.g., of washing machine 52) and wash chamber (e.g., of dishwasher 54) may be the container or containers. The appliance may further include one or more water supplies, as described above. The water supplies may include water supply conduits or pipes and one or more water supply valves. For instance, the water supply may include a hot water supply and a cold water supply, each having respective conduits and valves.

Accordingly, upon receiving the flushing initiation trigger, the controller may selectively activate or open the water supply valve or valves to supply water to the container. For instance, the controller may open a hot water valve on a hot water line to supply hot water (e.g., hot flushing water) to the container. The hot water valve may be maintained in the open position to allow the water from the hot water supply to be supplied to the container. As will be described in more detail below, the supply of the hot water to the container may be monitored by a temperature sensor (e.g., temperature sensor 156).

Similarly, the controller may open a cold water valve on a cold water line to supply cold water (e.g., cold flushing water) to the container. The cold water valve may be maintained in the open position to allow the water from the cold water supply to be supplied to the container. As will be described in more detail below, the supply of the cold water to the container may be monitored by a temperature sensor (e.g., temperature sensor 156).

At step 306, method 300 may include measuring a temperature of the flushing water (e.g., via a temperature sensor), and at step 308, method 300 may include determining that the temperature of the flushing water is above a predetermined temperature threshold. In detail, as the flushing water is being supplied to the container, the temperature sensor may monitor the temperature of the flushing water. As described above, the temperature sensor may be provided within the water supply or may be provided within the container. It should be understood that the disclosure is not limited to these locations and a placement of the temperature sensor may vary according to specific embodiments. Further, the controller may incorporate one or more additional methods or instruments to detect and monitor the temperature of the flushing water supplied to the container.

In at least one embodiment, the temperature sensor is provided within the water supply. For example, the temperature sensor is located at or near an outlet of the water supply, such that the temperature of the flushing water is monitored as it is being supplied to the container, or as the flushing water is exiting the water supply and entering the container. According to this embodiment, a real-time measurement of the temperature of the flushing water may take place. For instance, immediately as the flushing water is exiting the water supply, the temperature sensor is monitoring the temperature of the flushing water. Accordingly, the controller may simultaneously activate a drain pump of the appliance to immediately drain the flushing water from the container. Thus, the flow of the flushing water may be seamless through the container of the appliance, decreasing the amount of time required to perform the flushing operation.

According to another embodiment, the temperature sensor is provided on the container. In detail, the temperature sensor may be configured to monitor a temperature of the container (or a temperature of a liquid within the container). Accordingly, the temperature sensor may not monitor the temperature of the supplied flushing water in real time. Since the temperature of the flushing water is only determined once it is collected within the container, the drain pump may not be immediately activated when the flushing water is supplied to the tub.

Instead, the flushing water may be supplied to the container at a first time point. As the flushing water is collected within the container, the temperature sensor may take regular measurements of the temperature thereof. Flushing water may be continually supplied to the container as the temperature sensor continues to monitor the temperature of the container (or the flushing water therein). At a second time point, once the controller determines that the temperature of the flushing water within the container is at or above the predetermined temperature threshold (e.g., via the temperature sensor), the controller may halt the supply of the flushing water to the container. Thereafter, at a third time point, the controller may activate the drain pump to drain the flushing water from the container.

At step 310, method 300 may include stopping the flushing operation upon determining that the temperature of the flushing water is above the predetermined temperature threshold. As described above, the controller may cease the flushing operation once the temperature of the flushing water (and thus a safe temperature within the pipes of the building) are at a safe temperature to avoid freezing. Moreover, the controller may continue to monitor the flushing initiation triggers to determine if/when to restart the flushing operation. For instance, the controller may determine that a certain predetermined amount of time has passed from stopping the flushing operation that the pipes may again be in danger of freezing. The predetermined amount of time may be based on a number of factors, including the ambient atmospheric temperature, a level of activity within the building, a time of year, a time of day, a preset schedule, or the like.

Additionally or alternatively, the controller may determine that one or more objects are present within the container prior to supplying the flushing water to the container. For at least one example, the controller determines that a laundry load is present within the wash tub of the washing machine after receiving the initiation trigger to perform the flushing operation. Similarly, the controller may determine that a load of dishware is present within the wash chamber of the dishwasher after receiving the initiation trigger to perform the flushing operation. Accordingly, the controller may alert the user as to the presence of the one or more objects within the container.

For instance, the controller may send a notification to a connected mobile device of the user. The notification may be a push notification alerting the user that the flushing operation is about to begin and warning of the presence of objects within the container (e.g., tub) of the appliance or appliances. The controller may then temporarily halt the execution of the flushing operation, e.g., for a predetermined amount of time, to allow the user to remove the items from the container. In at least some embodiments, the controller waits for a signal (e.g., an all clear signal) from the user before initiating the flushing operation. In at least some other embodiments, the controller performs the flushing operation after the predetermined amount of time has elapsed. According to this embodiment, the controller then sends a notification to the user that the flushing operation has been performed and the objects may need to be rewashed.

According to the embodiments disclosed herein, a flushing operation may be selectively performed on certain connected appliances within a building. The controller of such appliances may receive an initiation trigger to perform the flushing operation, such as a detected ambient atmospheric temperature, a predetermined schedule, or a user input. The controller may then initiate the flushing operation by supplying water to a container of the appliance via a water supply. The water supply may be connected to a municipal supply, delivered to the appliance through connected pipes within the building's structure. The supplied water may be monitored by a temperature sensor to determine a temperature of the supplied flushing water, thus determining the temperature of the water within the connected pipes. Upon reaching and/or exceeding the predetermined temperature threshold, the controller may cease the flushing operation. The flushing water may be drained from the container, either during the supplying of the flushing water or after the determination of the predetermined temperature threshold. Thus, the pipes of buildings may avoid freezing and causing damage thereto.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an appliance, the appliance comprising a water supply, a temperature sensor provided in the water supply, a container, and a drain pump, the method comprising:

receiving a flushing initiation trigger to perform a flushing operation, wherein the flushing initiation trigger is based on at least one of an ambient atmospheric temperature, a user input, a time of day, a time of year, or a predetermined schedule;

initiating the flushing operation, the flushing operation comprising supplying flushing water to the container via the water supply and draining the flushing water from the container via the drain pump, wherein initiating the flushing operation comprises activating the drain pump simultaneously with the supplying of the flushing water to the container;

measuring, via the temperature sensor, a temperature of the flushing water supplied to the container;

determining that the temperature of the flushing water is above a predetermined temperature threshold; and stopping the flushing operation upon determining that the temperature of the flushing water is above the predetermined temperature threshold, wherein the user input comprises a vacancy setting, the vacancy setting denoting a period of inoccupancy of a building containing the appliance.

2. The method of claim 1, wherein the temperature sensor is provided within the container, and wherein initiating the flushing operation comprises:

supplying the flushing water to the container at a first time point;

determining that the temperature of the flushing water is above the predetermined temperature threshold at a second time point after the first time point; and activating the drain pump to drain the flushing water from the container at a third time point after the second time point.

3. The method of claim 1, wherein the appliance is a washing machine and the container is a wash tub, and wherein the water supply comprises a hot water supply and a cold water supply.

4. The method of claim 3, wherein supplying the flushing water to the container of the appliance via the water supply comprises:

opening a hot water valve to supply hot water from the hot water supply to the wash tub.

5. The method of claim 3, wherein supplying the flushing water to the container of the appliance via the water supply comprises:

opening a cold water valve to supply cold water from the cold water supply to the wash tub.

6. The method of claim 1, wherein the appliance is a dishwasher and the container is a washing chamber.

7. The method of claim 1, further comprising:

resupplying, via the water supply, flushing water to the container a predetermined amount of time after determining that the temperature of the flushing water is above the predetermined temperature threshold, wherein the predetermined amount of time is determined according to the ambient atmospheric temperature.

8. The method of claim 1, further comprising:

determining that one or more objects are present within the container prior to supplying the flushing water to the container; and alerting a user that the one or more objects are present within the container.

9. An appliance, comprising:

a container configured to store a liquid therein;

a liquid supply line fluidly connected to the container through which the liquid is supplied to the container;

a liquid supply valve provided on the liquid supply line and configured to selectively allow the liquid to pass through the liquid supply line into the container;

a temperature sensor provided at one of the liquid supply line or the container, the temperature sensor configured to detect a temperature of the liquid;

a drain line fluidly connected with the container through which the liquid drains from the container;

a drain pump connected to the drain line to selectively release the liquid from the container; and a controller provided within the appliance, the controller configured to perform a series of operations, the series of operations comprising:

receiving a flushing initiation trigger to perform a flushing operation;

initiating the flushing operation, the flushing operation comprising supplying flushing water to the container via the liquid supply line and draining the flushing water from the container via the drain pump;

determining that one or more objects are present within the container prior to supplying the flushing water to the container;

alerting a user that the one or more objects are present within the container;

measuring, via the temperature sensor, a temperature of the flushing water supplied to the container;

determining that the temperature of the flushing water is above a predetermined temperature threshold;

resupplying, via the liquid supply line, the flushing water to the container a predetermined amount of time after determining that the temperature of the flushing water is above the predetermined temperature threshold; and stopping the flushing operation upon determining that the temperature of the flushing water is above the predetermined temperature threshold and after resupplying the flushing water to the container.

10. The appliance of claim 9, wherein the appliance is a washing machine and the container is a wash tub, and wherein the liquid supply line comprises a hot water supply and a cold water supply.

11. The appliance of claim 10, wherein supplying the flushing water to the container of the appliance via the liquid supply line comprises:

opening a hot water valve to supply hot water from the hot water supply to the wash tub.

12. The appliance of claim 10, wherein supplying the flushing water to the container of the appliance via the liquid supply line comprises:

opening a cold water valve to supply cold water from the cold water supply to the wash tub.

13. The appliance of claim 9, wherein the appliance is a dishwasher and the container is a washing chamber.

14. The appliance of claim 9, wherein the flushing initiation trigger is based on at least one of an ambient atmospheric temperature, a user input, a time of day, a time of year, or a predetermined schedule.

15. The appliance of claim 14, wherein the user input comprises a vacancy setting, the vacancy setting denoting a period of inoccupancy of a building containing the appliance.

16. The appliance of claim 15, wherein the predetermined amount of time is determined according to the ambient atmospheric temperature.

* * * * *